US005103650A

United States Patent [19]

Jaster

[11] Patent Number: 5,103,650

[45] Date of Patent: Apr. 14, 1992

[54] REFRIGERATION SYSTEMS WITH MULTIPLE EVAPORATORS

[75] Inventor: Heinz Jaster, Schenectady, N.Y.

[73] Assignee: General Electric Company, Schenectady, N.Y.

[21] Appl. No.: 677,074

[22] Filed: Mar. 29, 1991

[51] Int. Cl.[5] ..... F25B 41/00

[52] U.S. Cl. ..... 62/198; 62/503; 62/510

[58] Field of Search ..... 62/198, 503, 510

[56] References Cited

U.S. PATENT DOCUMENTS

| | | | |
|---|---|---|---|
| 2,500,688 | 3/1950 | Kellie | 62/115 |
| 2,519,010 | 8/1950 | Zearfoss | 62/115 |
| 2,539,908 | 1/1951 | Jenkins | 62/8 |
| 2,590,741 | 3/1952 | Watkins | 62/503 |
| 2,667,756 | 2/1954 | Atchison | 62/8 |
| 2,719,407 | 10/1955 | Zearfoss | 62/6 |
| 2,844,945 | 7/1958 | Muffly | 62/160 |
| 2,966,043 | 12/1960 | Ross | 62/503 |
| 3,064,446 | 11/1962 | Dodge | 62/175 |
| 3,360,958 | 1/1968 | Miner | 62/470 |
| 4,179,898 | 12/1979 | Vakil | 62/503 |
| 4,317,335 | 3/1982 | Nakagawa et al. | 62/199 |
| 4,474,026 | 10/1984 | Mochizuki et al. | 62/157 |
| 4,513,581 | 4/1985 | Mizobuchi et al. | 62/197 |
| 4,644,756 | 2/1987 | Sugimoto et al. | 62/160 |
| 4,862,707 | 9/1989 | Hill et al. | 62/431 |
| 4,910,972 | 3/1990 | Jaster | 62/335 |
| 4,918,942 | 4/1990 | Jaster | 62/335 |
| 4,966,010 | 10/1990 | Jaster et al. | 62/179 |

FOREIGN PATENT DOCUMENTS

| | | |
|---|---|---|
| 192526 | 1/1986 | European Pat. Off. . |
| 431893 | 11/1911 | France . |
| 2295374 | 6/1974 | France . |
| 10577533 | 11/1983 | U.S.S.R. . |

OTHER PUBLICATIONS

"Refrigeration and Air Conditioning," W. F. Stoecker, McGraw-Hill Series in Mechanical Engineering, New York, 1958, pp. 56-61.

"Heat Pumps-Limitations and Potential," J. B. Comly et al., General Electric Technical Information Series, Report No. 75CRD185, Sep. 1975, pp. 7, 8 and 18.

"Principles of Refrigeration," R. J. Dossat, John Wiley and Sons, New York, 1976, pp. 240, 241, 430 and 536.

*Primary Examiner*—Ronald C. Capos

*Attorney, Agent, or Firm*—Patrick R. Scanlon; James C. Davis, Jr.; Paul R. Webb, II

[57] ABSTRACT

A refrigeration system suitable for use in household refrigerators having a fresh food compartment, a freezer compartment and an intermediate temperature compartment is provided. The system includes a first expansion throttle, a first evaporator for providing cooling to a freezer compartment, first, second and third compressors, a condenser, a second expansion throttle, a second evaporator for providing cooling to a fresh food compartment, a third expansion throttle, and a third evaporator for providing cooling to an intermediate compartment. All the above elements are connected in series, in that order, in a refrigerant flow relationship. A first phase separator connects the second evaporator to the third expansion throttle in a refrigerant flow relationship and provides intercooling between the second and third compressors. A second phase separator connects the third evaporator to the first expansion throttle in a refrigerant flow relationship and provides intercooling between the first and second compressors. An accumulator is connected between the first evaporator and the first compressor to regain lost cooling capacity in the event liquid refrigerant is discharged from the first evaporator.

6 Claims, 4 Drawing Sheets

REFRIGERATION SYSTEMS WITH MULTIPLE EVAPORATORS

CROSS REFERENCE TO RELATED APPLICATIONS

This application is related to the following copending applications: "Refrigeration System Including Capillary Tube/Suction Line Heat Transfer," Ser. No. 07/612,051, filed Nov. 9, 1990; "Refrigeration System and Refrigeration Control Apparatus Therefor," Ser. No 07/612,290, filed Nov. 9, 1990; and "Excess Refrigerant Accumulator for Multievaporator Vapor Compression Refrigeration Cycles," filed concurrently herewith. All of these related applications are assigned to the same assignee as the present invention. .

BACKGROUND OF THE INVENTION

The present invention relates to household refrigerators operating with a vapor compression cycle and more particularly, to refrigerators with a three stage compressor.

Currently produced household refrigerators operate on the simple vapor compression cycle. The cycle includes a compressor A, condenser B, expansion throttle C, evaporator D, and a two phase refrigerant. In the prior art refrigerator cycle of FIG. 1, a capillary tube acts as an expansion throttle. The capillary tube is placed in close proximity with the suction line of the compressor to cool the capillary tube. The subcooling which occurs to the refrigerant in the capillary tube increases the cooling capacity per unit mass flow rate in the system thereby increasing system efficiency which more than compensates for the disadvantage of increasing the temperature of the gas supplied to the compressor. The evaporator in FIG. 1 operates at approximately −10° F. Refrigerator air is blown across the evaporator and the air flow is controlled so that part of the air flow goes to the freezer compartment and the remainder of the flow goes to the fresh food compartment. The refrigerator cycle, therefore, produces its refrigeration effect at a temperature which is appropriate for the freezer, but lower than it needs to be for the fresh food compartment. Since the mechanical energy required to produce cooling at low temperatures is greater than it is at higher temperatures, the simple vapor compression cycle uses more mechanical energy than one which produces cooling at two temperature levels.

A well known procedure to reduce mechanical energy use is to operate two independent refrigeration cycles, one to serve the freezer at low temperatures and one to serve the fresh food compartment at an intermediate temperature. Such a system, however, is very costly.

Another problem which occurs in cooling for freezer operation in the simple vapor compression cycle, is the large temperature difference between the inlet and outlet temperatures of the compressor. The gas exiting the compressor is superheated, which represents a thermodynamic irreversibility which results in a relatively low thermodynamic efficiency. Lowering the amount of superheat will provide for decreased use of mechanical energy and therefore greater efficiency.

One solution to these problems is disclosed in U.S. Pat. No. 4,910,972 which is assigned to the same assignee as the present invention. U.S. Pat. No. 4,910,972 discloses a dual evaporator two stage cycle suitable for use in household refrigerators. The system comprises a first expansion valve, a first evaporator for cooling the freezer compartment, a first compressor, a second compressor, a condenser, a second expansion valve, and a second evaporator for cooling the fresh food compartment. All of the above elements are connected together in series in that order, in a refrigerant flow relationship. A phase separator connects the second evaporator to the first expansion valve and provides intercooling between the first and second compressors.

SUMMARY OF THE INVENTION

There is some recent interest in providing household refrigerators with a third food compartment which is maintained at a temperature intermediate to that of the typical freezer and fresh food compartments. Accordingly, it is an object of the present invention to extend the thermodynamic advantage of the dual evaporator two stage system to a refrigeration system having three or more evaporators.

It is a further object of the present invention to provide a refrigeration system which reduces the gas temperature at the compressor discharge ports.

It is a still further object of the present invention to provide a means for regaining lost cooling capacity in refrigeration systems suitable for use in household refrigerators.

These and other objects are accomplished in the present invention by providing a refrigeration system including a first expansion throttle, a first evaporator for providing cooling to a freezer compartment, first, second and third compressors, a condenser, a second expansion throttle, a second evaporator for providing cooling to a fresh food compartment, a third expansion throttle, and a third evaporator for providing cooling to an intermediate compartment. All the above elements are connected in series, in that order, in a refrigerant flow relationship. A first phase separator connects the second evaporator to the third expansion throttle in a refrigerant flow relationship and provides intercooling between the second and third compressors. A second phase separator connects the third evaporator to the first expansion throttle in a refrigerant flow relationship and provides intercooling between the first and second compressors. An accumulator is connected between the first evaporator and the first compressor to regain lost cooling capacity in the event liquid refrigerant is discharged from the first evaporator.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
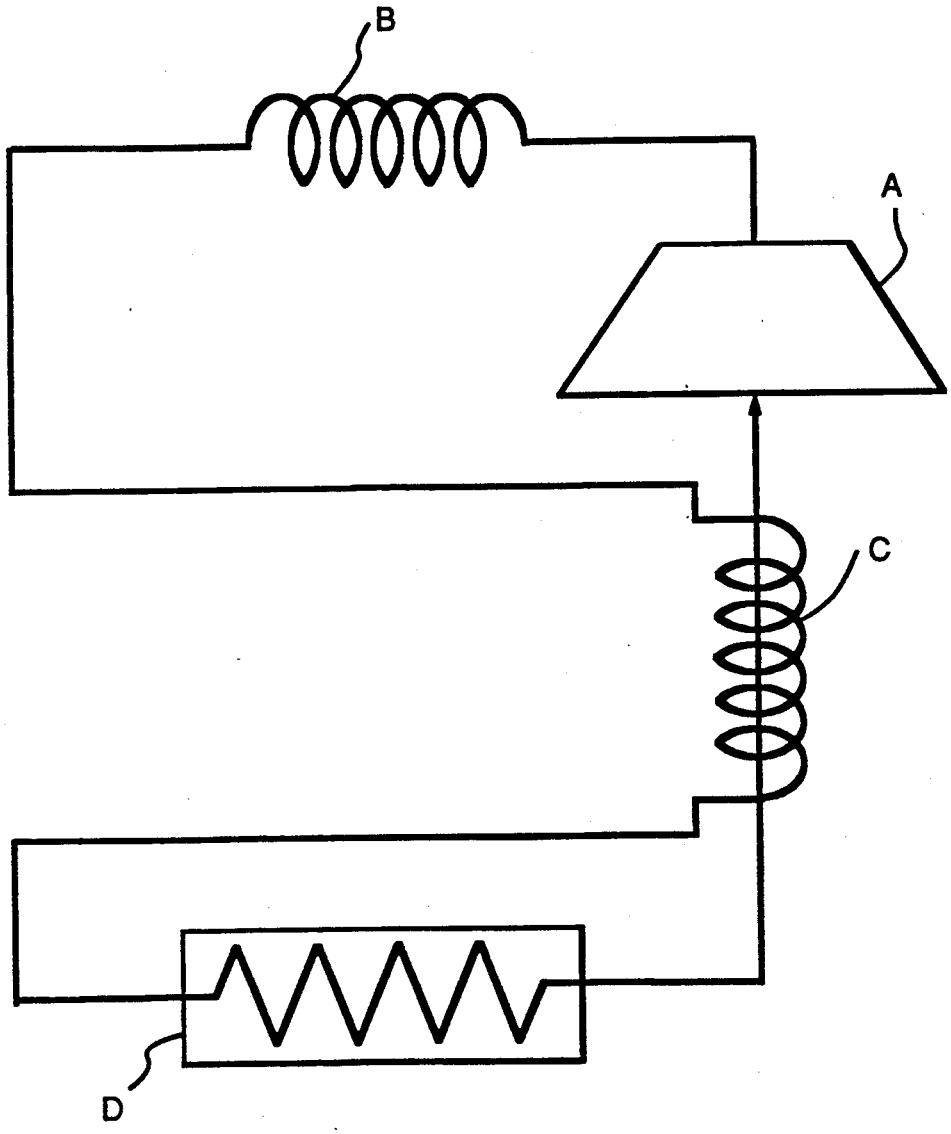
FIG. 1 ( PRIOR ART )
FIG. 1 is a schematic representation of a prior art vapor compression system used in a household refrigerator.
Figure 2:
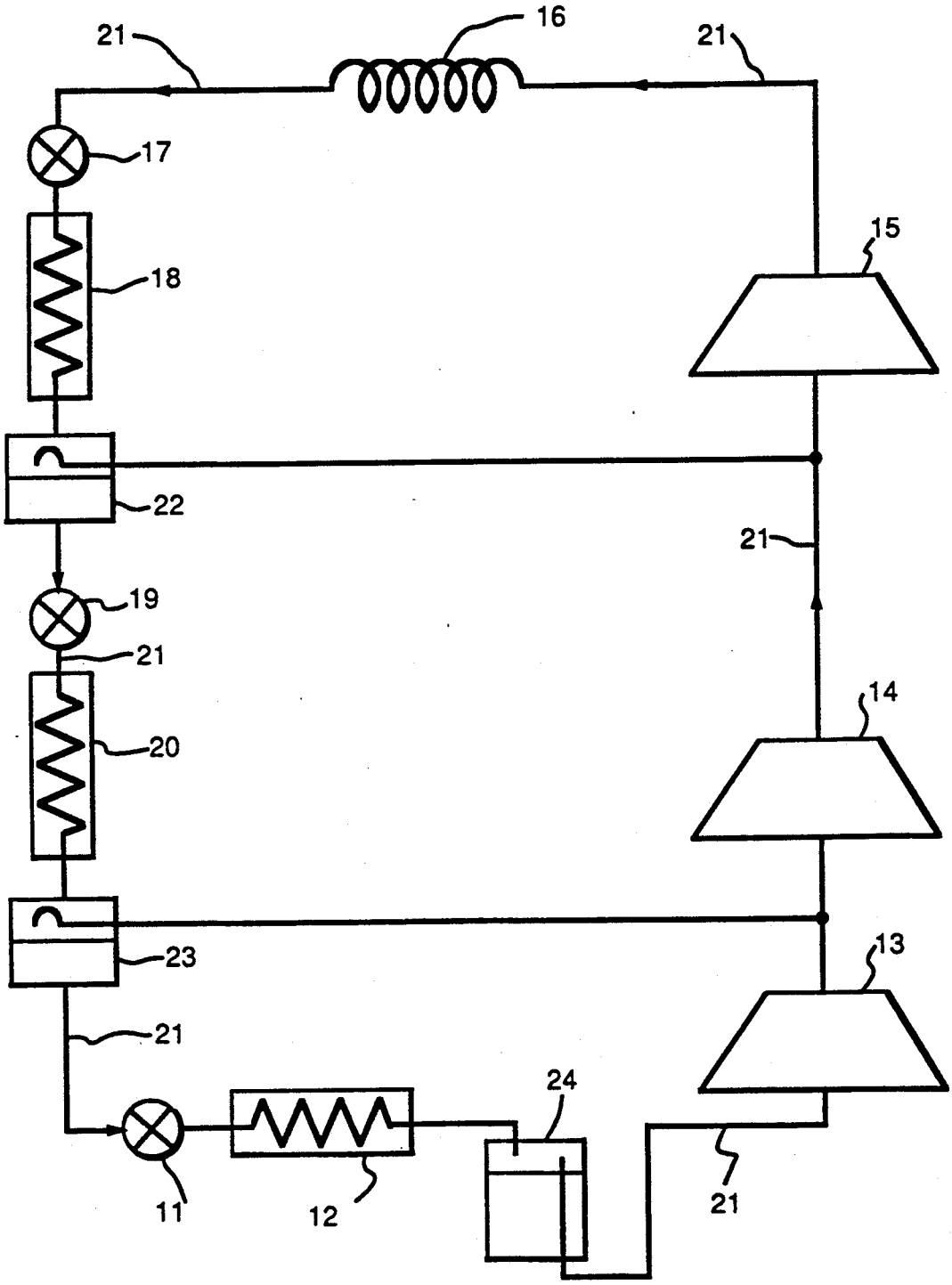
FIG. 2 is a schematic representation of a three evaporator, three stage system in accordance with the present invention.
Figure 3:
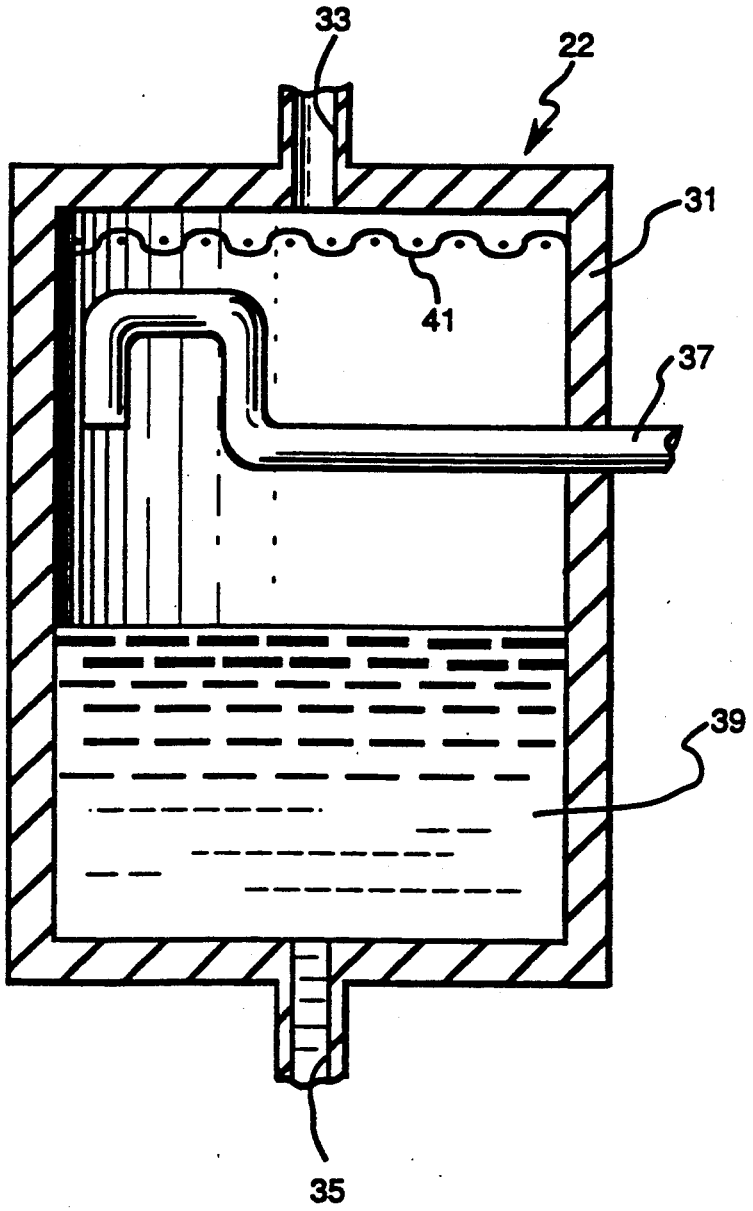
FIG. 3 is a sectional view of the phase separator of FIG. 2.

Referring now to FIG. 2, a preferred embodiment of a three evaporator, three stage system is shown. The system comprises a first expansion throttle 11, a first evaporator 12 for providing cooling to a freezer compartment, first, second and third compressors 13, 14 and 15, respectfully, a condenser 16, a second expansion throttle 17, a second evaporator 18 for providing cooling to a fresh food compartment, a third expansion throttle 19, and a third evaporator 20 for providing cooling to an intermediate temperature compartment. All the above elements are connected in series, in that order, in a refrigerant flow relationship by a conduit 21. As used herein, the term "expansion throttle" refers to any device, such as an orifice, an expansion valve or a capillary tube, which reduces the pressure of refrigerant passing therethrough. In a manner not shown, one, two or all of the expansion throttles may be placed in a heat exchange relationship with the suction line. A first phase separator 22, shown in cross section in FIG. 3, comprises a closed receptacle 31 having at the upper portion an inlet 33 for admitting liquid and gaseous phase refrigerant and having two outlets 35 and 37. A screen 41 is located in the upper portion of the receptacle to remove any solid material carried along by the refrigerant when entering the inlet 33. The first outlet 35 is located at the bottom of the receptacle 31 and provides liquid refrigerant 39. The second outlet 37 is provided by a conduit which extends from the interior of the upper portion of the receptacle to the exterior. The conduit is in flow communication with the upper portion and is arranged so that liquid refrigerant entering the upper portion of the receptacle through inlet 33 cannot enter the open end of the conduit. Two phase refrigerant from the outlet of the second evaporator 18 is connected to the inlet 33 of the phase separator 22. The phase separator provides liquid refrigerant to the third expansion throttle 19. The first phase separator 22 also provides saturated refrigerant vapor which combines with vapor output by the second compressor 14 and together are connected to the inlet of the third compressor 15. A second phase separator 23, identical in structure to the first phase separator, is also provided. The second phase separator 23 receives two phase refrigerant from the outlet of the third evaporator 20. The second phase separator 23 provides liquid refrigerant to the first expansion throttle 11. The second phase separator 23 also provides saturated refrigerant vapor which combines with vapor output by the first compressor 13 and together are connected to the inlet of the second compressor 14.

Ideally, the refrigerant will be completely vaporized in the first evaporator 12. However, when the first evaporator operates at a temperature which is lower than its design temperature, either due to decreased thermal load or compartment thermostat setting, the refrigerant is not completely vaporized and some refrigerant is discharged from the evaporator 12 in liquid form. This liquid refrigerant is effectively stored in the suction line between the first evaporator 12 and the first compressor 13. Liquid discharge to the suction line represents a loss of cooling capacity because the cooling produced by the evaporation of refrigerant in the suction line is released to the ambient and not the freezer compartment. Also, liquid discharge from the lowest temperature evaporator effectively transfers liquid refrigerant inventory from the phase separators to the suction line. Eventually, the phase separators will discharge two-phase refrigerant from the first outlet 35 instead of liquid refrigerant. Consequently, the flow rate through the expansion throttle will decrease.

Figure 4:
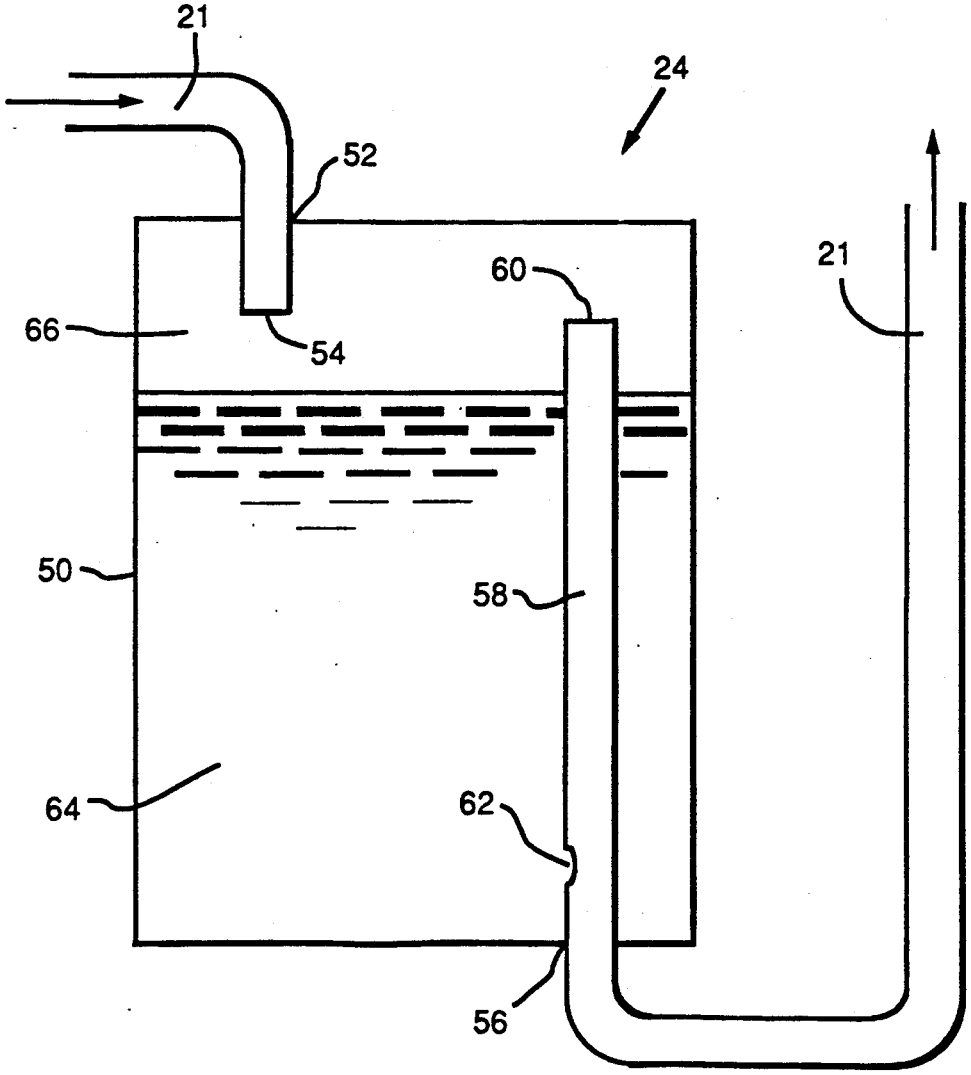
FIG. 4 is a sectional view of the accumulator of FIG. 2.

To overcome the problem of liquid discharge from the first evaporator 12, the present invention provides a cooling capacity regaining device, in the form of an accumulator 24, to the system. The accumulator 24 is connected to the outlet of the first evaporator 12 and is disposed within the freezer compartment. As seen in FIG. 4, the accumulator 24 comprises a closed receptacle 50. The receptacle must be of sufficient size to hold all excess liquid refrigerant that exists within the cycle at operating conditions. The receptacle 50 receives refrigerant discharged from the first evaporator 12 through an inlet in the top of the receptacle. The inlet comprises an aperture 52 in the top of the receptacle 50 through which the portion of the conduit 21 connecting the accumulator and the first evaporator extends. The conduit 21 terminates in an open end 54 a short distance within the receptacle 50. An outlet from the receptacle is also provided. The outlet comprises an aperture 56 in the bottom of the receptacle and an exit tube 58 which extends from the interior of the receptacle to the exterior via the aperture 56. The end of the exit tube 58 which is located within the receptacle 50 comprises an open end 60 located near the top of the receptacle. Outside of the receptacle 50, the exit tube 58 is connected with the portion of the main conduit 21 which is connected to the first compressor 13. An internal line transport bleeder hole 62 is provided in the exit tube 58 near the bottom of the receptacle 50 to prevent lubricant hold-up in the accumulator when the first evaporator is operating at design temperature and the accumulator is thus void of liquid refrigerant.

The accumulator 24 functions by receiving refrigerant discharged from the first evaporator 12. When the first evaporator is operating at lower than design temperature, the refrigerant entering the receptacle is in liquid and vapor form. The liquid refrigerant accumulates in a lower portion 64 of the receptacle, while the vapor refrigerant occupies an upper portion 66. Due to its position near the top of the receptacle, the open end 60 of the exit tube 58 only passes vapor refrigerant therethrough. Thus, liquid refrigerant is not passed to the suction line and all excess liquid refrigerant which is discharged from the first evaporator 12 is stored in the accumulator 24 and not the suction line. Because the accumulator is situated within the freezer compartment, excess liquid refrigerant cannot be evaporated externally of the freezer compartment and no cooling capacity is lost due to liquid refrigerant discharge from the evaporator.

In operation, the first evaporator 12 contains refrigerant at a temperature of approximately −10° F. for cooling the freezer compartment. The second evaporator 18 contains the refrigerant at a temperature of approximately 25° F. for cooling the fresh food compartment. The third evaporator 20 contains the refrigerant at a temperature between −10° F. and 25° F. for cooling the intermediate temperature compartment.

The first expansion throttle 11 is adjusted to obtain just barely dry gas flow, which can be accomplished, for example, by observing a sight glass located in the conduit 21 between the first evaporator 12 and the first compressor 13. The gas enters the first compressor 13 stage and is compressed. The gas discharged from the first compressor is mixed with gas at the saturation temperature from the second phase separator 23 and the two gases are further compressed by the second compressor 14. The gas discharged from the second compressor is mixed with gas at the saturation temperature from the first phase separator 22 and the two gases are further compressed by the third compressor 15. The high temperature, high pressure discharge gas from the third compressor is condensed in condenser 16 with the second expansion throttle 17 adjusted to obtain some subcooling of the liquid exiting the condenser. This can be accomplished by observing a sight glass situated between the condenser 16 and the second expansion throttle 17. The liquid refrigerant condensed in the condenser 16 passes through the second expansion throttle where it expands from the high pressure of the condenser 16 to a lower intermediate pressure in the second evaporator 18. The expansion of the liquid causes part of the liquid to evaporate and cool the remainder to the second evaporator temperature. The liquid and gas phase refrigerant enters the first phase separator 22. Liquid refrigerant accumulates in the lower portion of the receptacle and gas accumulates in the upper portion. The phase separator supplies the gas portion to be combined with the gas exiting the second stage compressor 14. The gas from the phase separator 22 is at approximately 25° F. and cools the gas exiting from the second stage compressor, thereby lowering the gas temperature entering the third compressor 15 from what it would have otherwise have been without the intercooling.

Liquid refrigerant from the first phase separator is supplied to the third expansion throttle 19 where it expands to a lower intermediate pressure in the third evaporator 20. The expansion of the liquid causes part of the liquid to evaporate and cool the remainder to the third evaporator temperature. The liquid and gas phase refrigerant enters the second phase separator 23. Liquid refrigerant accumulates in the lower portion of the receptacle and gas accumulates in the upper portion. The phase separator supplies the gas portion to be combined with the gas exiting the first stage compressor 13. The gas from the second phase separator 23 cools the gas exiting from the first stage compressor, thereby lowering the gas temperature entering the second compressor 14 from what it would have otherwise have been without the intercooling. The liquid of the two phase mixture from the third evaporator 20 flows from the second phase separator 23 through the first expansion throttle 11 causing the refrigerant to a still lower pressure. The remaining liquid evaporates in the first evaporator 12 cooling the evaporator to approximately −10°0 F. A sufficient refrigerant charge is supplied to the system so that the desired liquid level can be maintained in the phase separator.

The pressure ratio of the three compressors is determined by the refrigerant used and the temperatures at which the evaporators are to operate. The pressure at the input to the first compressor 13 is determined by the pressure at which the refrigerant exists in two phase equilibrium at −10° F. The pressure at the output of the first compressor is determined by the saturation pressure of the refrigerant at the intermediate temperature. The temperature of the condenser 16 has to be greater than that of the ambient temperature in order to function as a condenser. If the condenser is to operate at 105° F., for example, then the pressure of the refrigerant at saturation can be determined. The volume displacement capability of the compressors are determined by the amount of cooling capacity the system requires at each of the three temperature levels, which determines the mass flow rate of the refrigerant through the compressors.

The three evaporator, three-stage cycle requires less mechanical energy compared to a single evaporator single compressor cycle with the same cooling capacity. The efficiency advantages come about due to the fact that the gas leaving the higher temperature evaporators is compressed from an intermediate pressure, rather than from the lower pressure of the gas leaving the lowest temperature evaporator. Also contributing to improved efficiency is the cooling of the gas exiting the first and second compressors by the addition of gas cooled to saturation temperature from the respective phase separators. The cooling of the gas entering the second and third compressors reduces the mechanical energy requirement of those two compressors.

The foregoing has described a three evaporator, three stage refrigeration system suitable for household refrigerators that has improved thermodynamic efficiency. The system also has a means for regaining lost cooling capacity.

While specific embodiments of the present invention have been described, it will be apparent to those skilled in the art that various modifications thereto can be made without departing from the spirit and scope of the invention as defined in the appended claims.

What is claimed is:

1. A refrigerator system for use in a refrigerator having a freezer compartment, an intermediate temperature compartment and a fresh food compartment comprising:

a first expansion throttle;

a first evaporator for providing cooling to the freezer compartment;

a first, second and third compressor;

a condenser;

a second expansion throttle;

a second evaporator for providing cooling to the fresh food compartment;

a third expansion throttle;

a third evaporator for providing cooling to the intermediate temperature compartment, all the above elements connected together in series, in that order, in a refrigerator flow relationship;

a first phase separator connecting said second evaporator to said third expansion throttle in a refrigerant flow relationship, said first phase separator providing intercooling between said second and third compressors; and a second phase separator connecting said third evaporator to said first expansion throttle in a refrigerant flow relationship, said second phase separator providing intercooling between said first and second compressors.

2. The refrigerator system of claim 1 wherein said first phase separator comprises means adapted for receiving liquid and gas phase refrigerant from said second evaporator and means for providing liquid refrigerant to said third expansion throttle, and said second phase separator comprises means adapted for receiving liquid and gas phase refrigerant from said third evaporator and means for providing liquid refrigerant to said first expansion throttle.

3. The refrigerator system of claim 2 wherein said first phase separator comprises means for providing saturated gas to the third compressor so that said third compressor receives gas phase refrigerant from said second compressor and from said first phase separator, and said second phase separator comprises means for providing saturated gas to the second compressor so that said second compressor receives gas phase refrigerant from said first compressor and from said second phase separator.

4. The refrigerator system of claim 3 wherein said first phase separator comprises a first receptacle for accumulating liquid refrigerant in the lower portion and gas refrigerant in the upper portion, and said second phase separator comprises a second receptacle for accumulating liquid refrigerant in the lower portion and gas refrigerant in the upper portion 5. The refrigerator system of claim 1 further comprising an excess refrigerant accumulator connected to the outlet of said first evaporator and situated within the freezer compartment.

6. A refrigerator system for use in a refrigerator having a freezer compartment, an intermediate temperature compartment and a fresh food compartment comprising a first expansion throttle;

a first evaporator for providing cooling to the freezer compartment;

a first, second and third compressor;

a condenser;

a second expansion throttle;

a second evaporator for providing cooling to the fresh food compartment;

a third expansion throttle;

a third evaporator for providing cooling to the intermediate temperature compartment, all the above elements connected together in series, in that order, in a refrigerator flow relationship;

a first phase separator means for receiving liquid and gas phase refrigerant from said second evaporator and supplying liquid refrigerant to said third expansion throttle and saturated refrigerant gas to said third compressor, so that gas from said second compressor and from said first phase separator are supplied to said third compressor; and a second phase separator means for receiving liquid and gas phase refrigerant from said third evaporator and supplying liquid refrigerant to said first expansion throttle and saturated refrigerant gas to said second compressor, so that gas from said first compressor and from said second phase separator are supplied to said second compressor.

* * * * *